US010121397B1

(12) United States Patent
Stevens et al.

(10) Patent No.: US 10,121,397 B1
(45) Date of Patent: Nov. 6, 2018

(54) FLAG POLE

(71) Applicants: Mark Stevens, Cranston, RI (US); Lynn Stevens, Cranston, RI (US)

(72) Inventors: Mark Stevens, Cranston, RI (US); Lynn Stevens, Cranston, RI (US)

( * ) Notice: Subject to any disclaimer, the term of this patent is extended or adjusted under 35 U.S.C. 154(b) by 149 days.

(21) Appl. No.: 15/168,563

(22) Filed: May 31, 2016

(51) Int. Cl.
*G09F 17/00* (2006.01)

(52) U.S. Cl.
CPC ..... *G09F 17/00* (2013.01); *G09F 2017/0041* (2013.01)

(58) Field of Classification Search
CPC ..... G09F 17/00; G09F 2017/0041
USPC .... 116/28 R, 173–175, 209; 40/601, 607.01, 40/607.04–607.07, 607.09, 607.13, 617
See application file for complete search history.

(56) References Cited

U.S. PATENT DOCUMENTS 643,945 A * 2/1900 Clifford ..... G09F 17/00 116/173
1,002,260 A * 9/1911 Golden ..... B61L 5/125 116/173
D102,908 S * 1/1937 Lewis ..... D10/109.1
2,646,240 A * 7/1953 Anderson ..... B60R 13/00 116/173
3,587,520 A 6/1971 Miller
4,357,772 A * 11/1982 Amick ..... G09F 7/18 248/159
4,880,195 A * 11/1989 Lepley ..... G09F 17/00 248/219.4
5,295,500 A * 3/1994 Leu ..... E04H 12/2238 135/114
D345,947 S * 4/1994 Brown ..... D11/166
D403,617 S * 1/1999 Zeese ..... D11/166
5,881,495 A * 3/1999 Clark ..... A01G 9/12 135/118
5,921,035 A * 7/1999 Kempf ..... E04H 12/2223 248/545
5,943,980 A 8/1999 Huang
6,637,171 B1 * 10/2003 Toone ..... E04C 5/167 248/156
6,668,750 B1 * 12/2003 Walz ..... E04H 12/32 116/173
6,799,530 B1 10/2004 Heichelbech
6,938,871 B1 * 9/2005 Carlson ..... G09F 17/00 248/519
7,168,389 B2 1/2007 Piedmont
(Continued)

FOREIGN PATENT DOCUMENTS

CA 2551150 A1 12/2007

*Primary Examiner* — R. A. Smith
*Assistant Examiner* — Tania Courson

(57) ABSTRACT

The flag pole is a mast and banner pole assembly that is adapted for use in displaying flags and banners. The flag pole is mounted to the ground through the use of a ground post such that the flag pole can be rotated using the ground post as the center of rotation. This configuration allows the position of the flag or banner to be adjusted in a manner that will control the visibility of the flag or banner. Once the flag or banner is rotated into the desired position, the flag pole can be locked in position. The banner pole is removably attached to the mast. The flag pole further comprises an acute angle which displays the flag or banner at an acute angle relative to a line perpendicular to the ground. The flag pole comprises a mast, a banner pole, a ground post, and an acute angle.

3 Claims, 4 Drawing Sheets

(56) References Cited

U.S. PATENT DOCUMENTS

| | | | | |
|---|---|---|---|---|
| D584,363 | S * | 1/2009 | Gordon | D12/400 |
| D645,379 | S | 9/2011 | Downey | |
| 9,447,599 | B1 * | 9/2016 | Parent | E04H 12/2223 |
| 2001/0003878 | A1 * | 6/2001 | Dawkins | G09F 17/00 40/603 |
| 2002/0124447 | A1 * | 9/2002 | Burke | G09F 7/22 40/607.07 |
| 2007/0246626 | A1 * | 10/2007 | Reynolds | G09F 17/00 248/281.11 |
| 2008/0098951 | A1 * | 5/2008 | Sullivan | G09F 17/00 116/173 |
| 2009/0013921 | A1 * | 1/2009 | Yun | A47F 5/0823 116/173 |
| 2010/0018095 | A1 * | 1/2010 | Molla | G09F 7/22 40/606.16 |
| 2010/0122652 | A1 * | 5/2010 | Schofield | G09F 17/00 116/173 |
| 2018/0061287 | A1 * | 3/2018 | Gladfelter | G09F 17/0091 |

* cited by examiner

FLAG POLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings and masts, more specifically, a flag pole adapted for use with a flag or banner.

SUMMARY OF INVENTION

The flag pole is a mast and banner pole assembly that is adapted for use in displaying flags or banners. The flag pole is mounted to the ground through the use of a ground post such that the flag pole can be rotated using the ground post as the center of rotation. This configuration allows the position of the flag or banner to be adjusted in a manner that will control the visibility of the flag or banner. Once the flag or banner is rotated into the desired position, the flag pole can be locked in position. The banner pole is removably attached to the mast thus allowing for the addition or replacement of a flag or banner to the banner pole at a location separated from the mast. The flag pole further comprises an acute angle which displays the flag or banner at an acute angle relative to a line perpendicular to the ground.

These together with additional objects, features and advantages of the flag pole will be readily apparent to those of ordinary skill in the art upon reading the following detailed description of the presently preferred, but nonetheless illustrative, embodiments when taken in conjunction with the accompanying drawings.

In this respect, before explaining the current embodiments of the flag pole in detail, it is to be understood that the flag pole is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flag pole.

It is therefore important that the claims be regarded as including such equivalent construction insofar as they do not depart from the spirit and scope of the flag pole. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
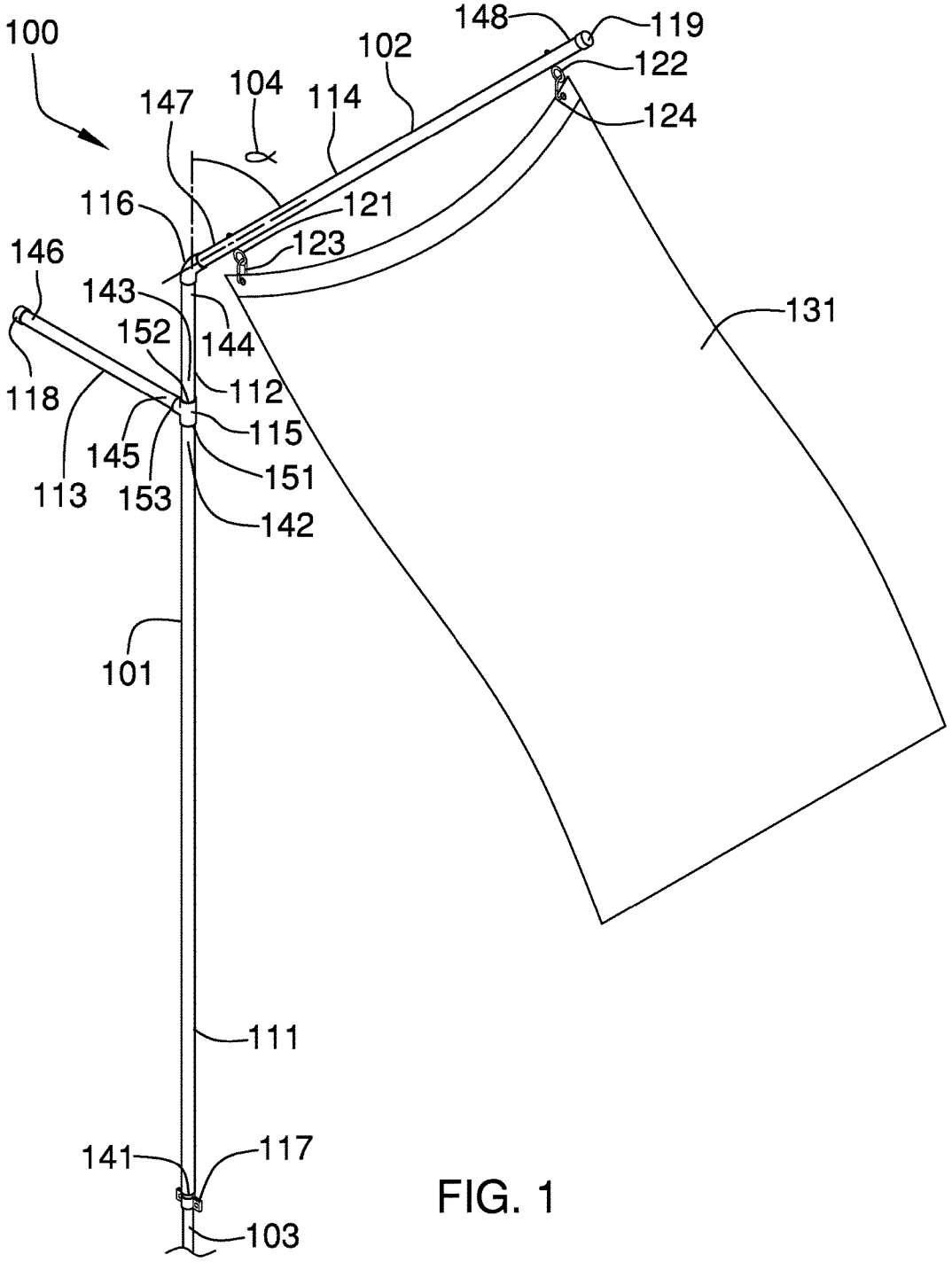
FIG. 1 is a perspective view of an embodiment of the disclosure.
Figure 2:
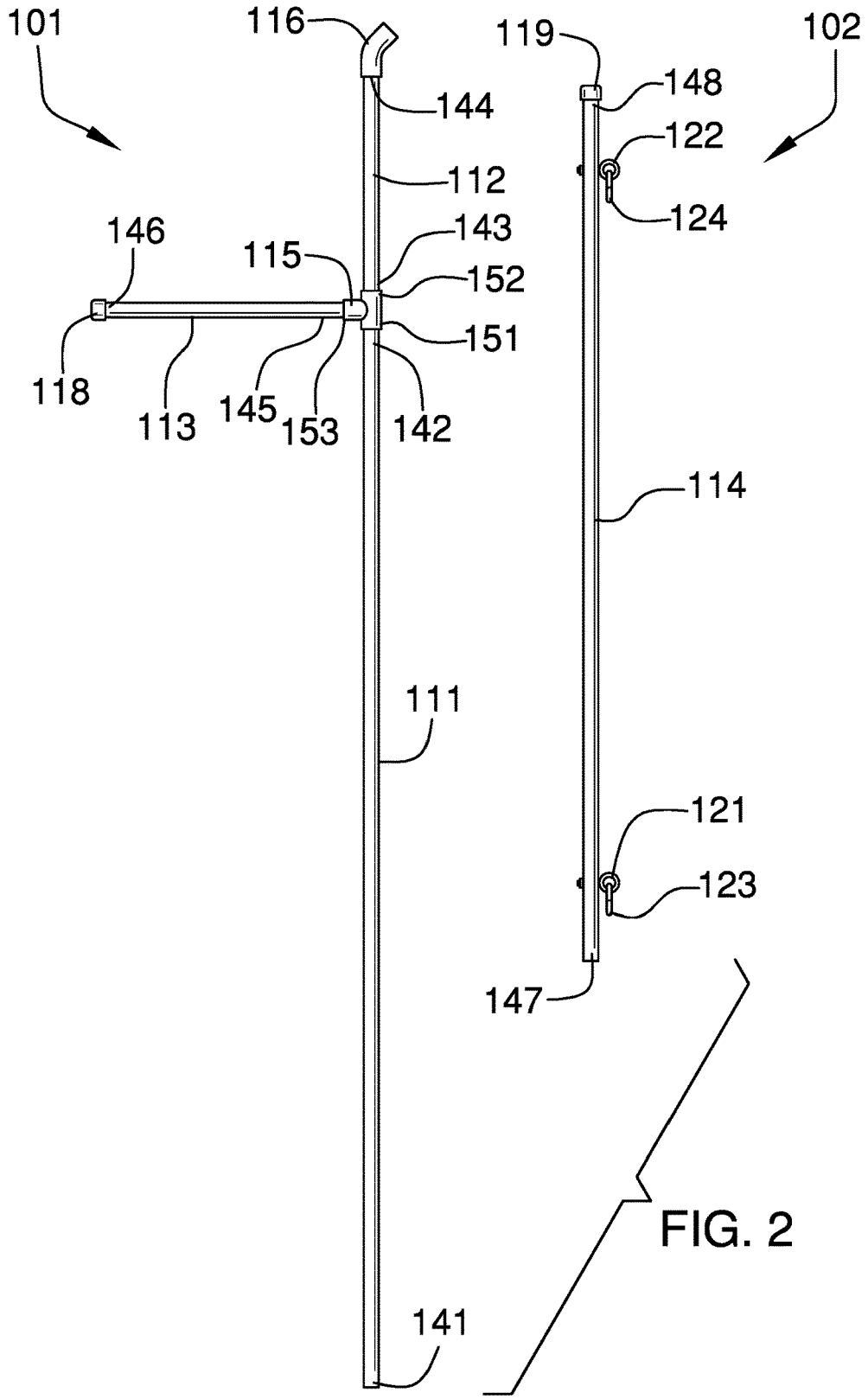
FIG. 2 is an exploded view of an embodiment of the disclosure.
Figure 3:
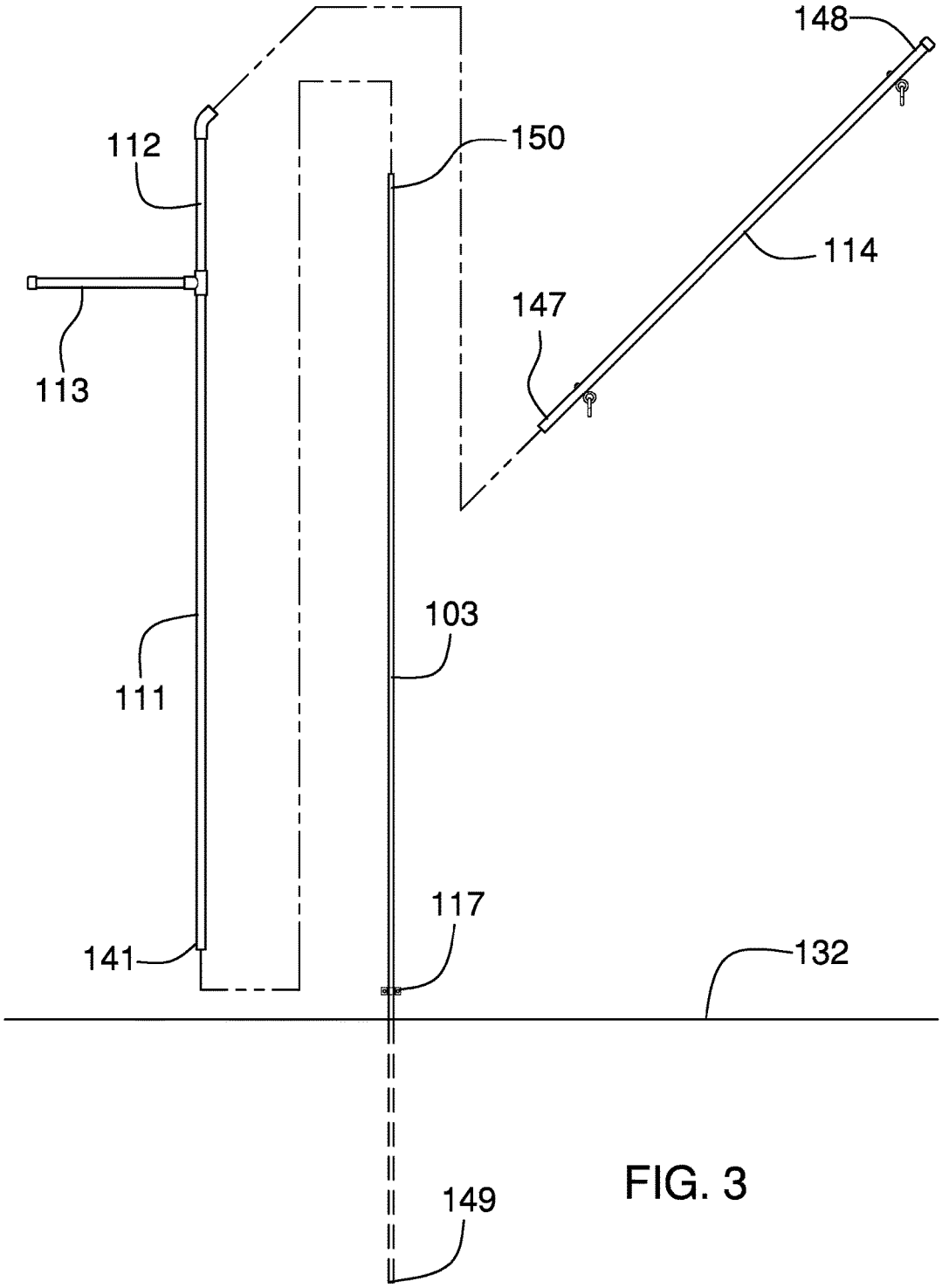
FIG. 3 is an in use view of an embodiment of the disclosure.
Figure 4:
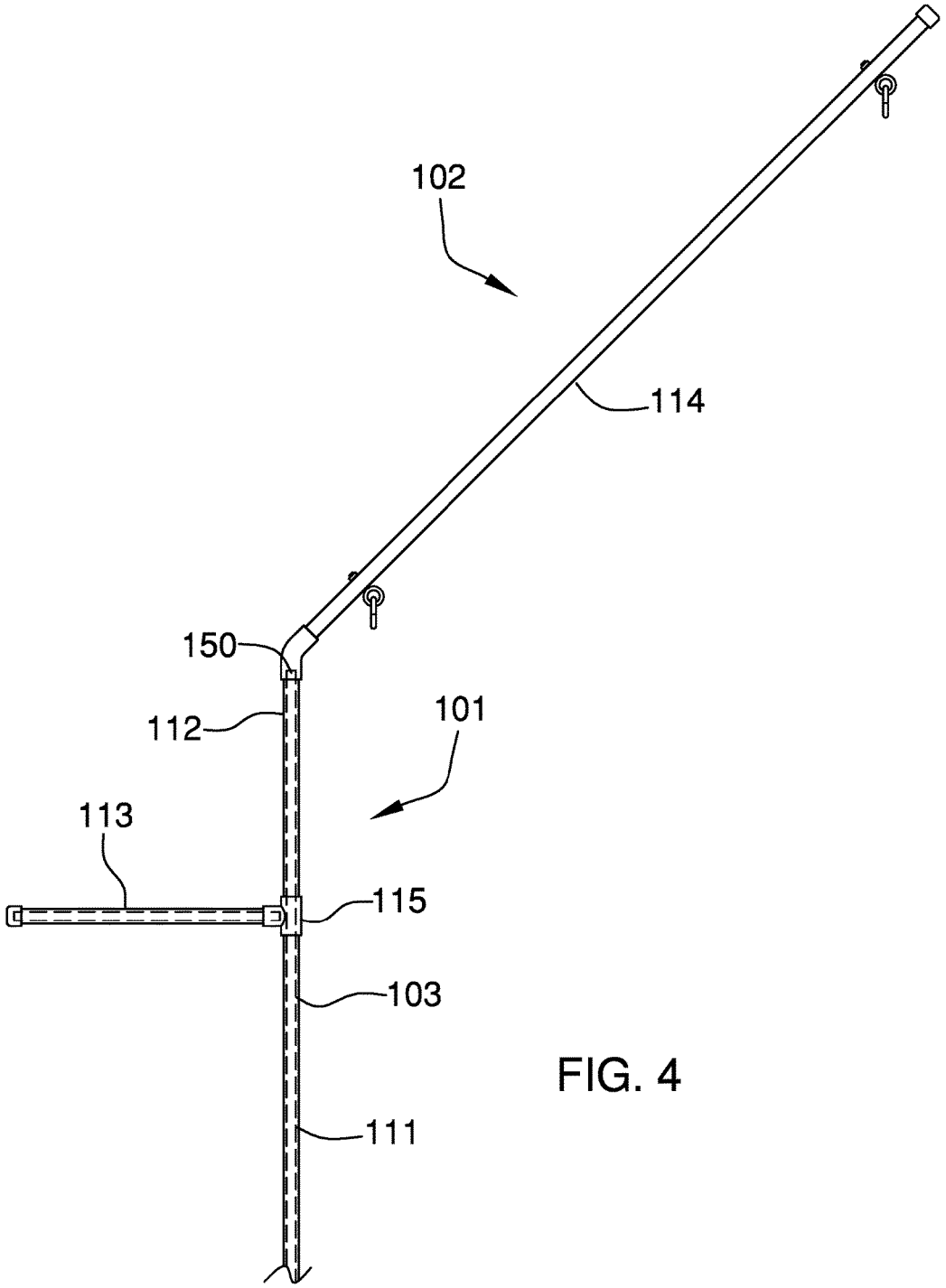
FIG. 4 is a front view of an embodiment of the disclosure.

Detailed reference will now be made to one or more potential embodiments of the disclosure, which are illustrated in FIGS. 1 through 4.

The flag pole 100 (hereinafter invention) comprises a mast 101, a banner pole 102, a ground post 103, and an acute angle 104. The invention 100 is a mast 101 and banner pole 102 assembly that is adapted for use in displaying a flag or a banner 131 (hereinafter flag). The invention 100 is mounted to the ground 132 through the use of a ground post 103 such that the invention 100 can be rotated using the ground post 103 as the center of rotation. This configuration allows the position of the flag 131 to be adjusted in a manner that will control the visibility of the flag 131. Once the flag 131 is rotated into the desired position, the invention 100 can be locked in position. The banner pole 102 is removably attached to the mast 101 thus allowing for the addition or replacement of a flag 131 to the banner pole 102 at a location separated from the mast 101. The acute angle 104 further displays the flag 131 at an acute angle 104 relative to a line perpendicular to the ground 132.

The mast 101 further comprises a first pipe 111, a second pipe 112, a third pipe 113, a Tee connector 115, a 45 degree connector 116, a clamp 117, and a first end cap 118. The first pipe 111 is further defined with a first end 141 and a second end 142. The second pipe 112 is further defined with a third end 143 and a fourth end 144. The third pipe 113 is further defined with a fifth end 145 and a sixth end 146. The Tee connector 115 is further defined with a first branch 151, a second branch 152 and a third branch 153. The center axis of the third branch 153 is perpendicular to the center axis of the first branch 151 and the center axis of the second branch 152. The center axis of the first branch 151 and the center axis of the second branch 152 are aligned.

The banner pole 102 further comprises a fourth pipe 114, a second end cap 119, a first eyebolt 121, and a second eyebolt 122. The fourth pipe 114 is further defined with a seventh end 147 and an eighth end 148. The first eyebolt 121 further comprises a first carabiner 123. The second eyebolt 122 further comprises a second carabiner 124.

The ground post 103 is a shaft that is driven into the ground 132 much like a fence post. It is preferred that the shaft be formed from a metal such as iron or aluminum. The ground post 103 is further defined with a ninth end 149 and a tenth end 150. The span of the outer diameter of the shaft is less than the inner diameter of the first pipe 111, the second pipe 112, and the Tee connector 115 such that the ground post 103 will fit inside the mast 101.

The assembly of the invention 100 is described in the next 4 paragraphs.

The preparation of the ground post 103 is described in this paragraph. The ninth end 149 of the ground post 103 is driven into the ground 132 in such that the center axis of the ground post 103 is perpendicular to the ground 132. The ground post 103 is the support upon which the balance of the invention 100 is mounted. The length of the ground post 103 and the depth the ground post 103 is driven into the ground 132 are selected such that the environmental forces the invention 100 is subjected to will: 1) not cause the ground post 103 to lose its perpendicular angle relative to the ground 132; or, 2) cause the mast 101 to be lifted off the ground post 103.

The assembly of the mast 101 is described in this paragraph. The second end 142 of the first pipe 111 is inserted into the first branch 151 of the Tee connector 115 and is secured with an adhesive. The third end 143 of the second pipe 112 is inserted into the second branch 152 of the Tee connector 115 and is secured with an adhesive. The fifth end 145 of the third pipe 113 is inserted into the third branch 153 of the Tee connector 115 and is secured with an adhesive. The fourth end 144 of the second pipe 112 is inserted into an end of the 45 degree connector 116. The 45 degree connector 116 is attached to the second pole 112 such that: 1) the center axis of the 45 degree connector 116 lies in the plane formed by the center axis of the second pipe 112 and the center axis of the third pipe 113; and, 2) the banner pole 102 will project away from the third pipe 113 when the banner pole 102 is inserted into the 45 degree connector 116. The fourth end 144 of the second pipe is secured to the 45 degree connector 116 using an adhesive. The first end cap 118 is secured to the sixth end 146 of the third pipe 113 with an adhesive.

The assembly of the banner pole 102 is described in this paragraph. The first eyebolt 121 is installed in the fourth pipe 114 by drilling a first hole and a second hole through the side wall of the fourth pipe 114 such that a line drawn from the center of the first hole to the center of the second hole will run perpendicularly through center axis of the fourth pipe 114. The first hole and the second hole receives the first eyebolt 121 which is secured using commonly available hardware. The first carabiner 123 is attached to the eyelet of the first eyebolt 121. The second eyebolt 122 is installed in the fourth pipe 114 by drilling a third hole and a fourth hole through the side wall of the fourth pipe 114 such that a line drawn from the center of the third hole to the center of the fourth hole will run perpendicularly through center axis of the fourth pipe 114. The third hole and the fourth hole receives the second eyebolt 122 which is secured using commonly available hardware. The second carabiner 124 is attached to the eyelet of the second eyebolt 122. The second end cap 119 is attached to the eighth end 148 of the fourth pipe 114 using an adhesive.

To assemble the invention 100, the first end 141 of the first pipe 111 is slid over the tenth end 150 of the ground post 103. A flag 131 is attached to the banner pole 102 using the first carabiner 123 and the second carabiner 124. The seventh end 147 of the fourth pipe 114 is inserted in the remaining open end of the 45 degree connector 116. The clamp 117 then attaches the mast 101 to the ground post 103 in order to prevent the mast 101 from rotating around the ground post 103 once the banner pole 102 has been placed in the proper position. The clamp 117 comprises commercially available hardware.

Once the banner pole 102 is attached to the mast 101, the banner pole 102 can be rotated using the ground post 103 as the center of rotation using the third pipe 113 as a handle.

In the first potential embodiment of the disclosure, the ground post 103 is formed from commercially available aluminum, steel or copper pipes commonly used in plumbing applications. Mast 101 is formed from PVC components commonly used in plumbing applications. The fourth pipe 114 and the second end cap 119 are formed from PVC components commonly used in plumbing applications. The clamp 117, the first eyebolt 121, and the second eyebolt 122 are assembled from commonly available hardware components The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Carabiner: As used in this disclosure, a carabiner is coupling link that is usually formed as an oblong metal ring with one spring hinged side that is used to open and close the ring. Synonyms for carabiner include D-link.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Flag: As used in this disclosure, a flag is a textile or sheeting material that attached by one edge to a pole or a rope. In general usage, a flag will display an image that often contains some form of symbolic meaning or message. This definition maps to the common patent classification definitions and is therefore explicitly intended to include flag like objects commonly referred to as a "banner".

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pipe: As used in this disclosure, a pipe is a hollow cylindrical device that is used for transporting liquids and gasses. The line that connects the center of the first base of the cylinder to the center of the second base of the cylinder is referred to as the axis of the cylinder or the centerline of the pipe. When two pipes share the same centerline they is said to be aligned. In this disclosure, the terms inner diameter of a pipe and outer diameter are used as they would be used by those skilled in the plumbing arts.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A flag pole comprising:

a mast, a banner pole, and a ground post;

wherein the flag pole in displaying a flag;

wherein the mast is mounted to the ground with the ground post;

wherein the banner pole is removably attached to the mast;

wherein the mast can be rotated with the ground post as the center of rotation;

wherein the mast and the banner pole form an acute angle;

wherein the mast further comprises a first pipe, a second pipe, a third pipe, a Tee connector, a 45 degree connector, a clamp, and a first end cap;

wherein the first pipe, the second pipe and the third pipe attach to the Tee connector;

wherein the second pipe attaches to the 45 degree connector;

wherein the first end cap attaches to the third pipe;

wherein the clamp attaches the mast to the ground post;

wherein the first pipe is a pipe that is further defined with a first end and a second end;

wherein the second pipe is a pipe that is further defined with a first end and a second end;

wherein the third pipe is a pipe that is further defined with a first end and a second end;

wherein the Tee connector is further defined with a first branch, a second branch and a third branch;

wherein the center axis of the third branch is perpendicular to the center axis of the first branch and the center axis of the second branch;

wherein the center axis of the first branch and the center axis of the second branch are aligned;

wherein the banner pole further comprises a fourth pipe, a second end cap, a first eyebolt, and a second eyebolt;

wherein the first eyebolt, the second eyebolt, and the second end cap attach to the fourth pipe;

wherein the fourth pipe is a pipe that is further defined with a first end and a second end;

wherein the ground post is a shaft that is driven into the ground;

wherein the ground post further defined with a first end and a second end;

wherein the span of the outer diameter of the shaft is less than the inner diameter of the first pipe;

wherein the span of the outer diameter of the shaft is less than the inner diameter of the second pipe;

wherein the span of the outer diameter of the shaft is less than the inner diameter of the first branch of the Tee connector;

wherein the span of the outer diameter of the shaft is less than the inner diameter of the second branch of the Tee connector;

wherein the first end of the ground post is driven into the ground in such that the center axis of the ground post is perpendicular to the ground;

wherein the length of the ground post is selected such that the environmental forces the flag pole is subjected to will not cause the ground post to lose its perpendicular angle relative to the ground;

wherein the length of the ground post is selected such that the environmental forces the flag pole is subjected to will not cause the mast to be lifted off the ground post;

wherein the depth the ground post is driven into the ground is selected such that the environmental forces the flag pole is subjected to will not cause the ground post to lose its perpendicular angle relative to the ground;

wherein the depth the ground post is driven into the ground is selected such that the environmental forces the flag pole is subjected to will not cause the mast to be lifted off the ground post;

wherein the second end of the first pipe is inserted into the first branch of the Tee connector;

wherein the second end of the first pipe is secured in the first branch of the Tee connector with an adhesive;

wherein the first end of the second pipe is secured in the second branch of the Tee connector with an adhesive;

wherein the first end of the third pipe is inserted into the third branch of the Tee connector;

wherein the first end of the third pipe is secured to the third branch of the Tee connector with an adhesive;

wherein the first end cap is secured to the second end of the third pipe with an adhesive;

wherein the second end of the second pipe is inserted into an end of the 45 degree connector;

wherein the second end of the second pipe is secured to the 45 degree connector with an adhesive;

wherein a first hole and a second hole is formed through the side wall of the fourth pipe such that a line drawn from the center of the first hole to the center of the second hole will run perpendicularly through center axis of the fourth pipe;

wherein a third hole and a fourth hole through the side wall of the fourth pipe such that a line drawn from the center of the third hole to the center of the fourth hole will run perpendicularly through center axis of the fourth pipe;

wherein the first hole and the second hole receives the first eyebolt;

wherein the third hole and the fourth hole receives the second eyebolt;

wherein the first end of the first pipe is slid over the second end of the ground post;

wherein the first end of the fourth pipe is inserted in the 45 degree connector;

wherein the 45 degree connector is attached to the second pipe such that the center axis of the 45 degree connector lies in the plane formed by the center axis of the second pipe and the center axis of the third pipe;

wherein the 45 degree connector is attached to the second pipe such that the banner pole will project away from the third pipe when the banner pole is inserted into the 45 degree connector.

2. The flag pole according to claim 1 wherein the first eyebolt further comprises a first carabiner;

wherein the second eyebolt further comprises a second carabiner.

3. The flag pole according to claim 2 wherein the ground post is formed from a metal selected from the group consisting of aluminum and iron.

* * * * *